US007506669B2

(12) United States Patent
Hofstetter et al.

(10) Patent No.: US 7,506,669 B2
(45) Date of Patent: Mar. 24, 2009

(54) SUPPORT FOR THE REED OF A SEAM-WEAVING MACHINE FOR ROLLING-IN THE SEAM-WEFT THREAD ALTERNATIVELY BY TILTING THE REED DENTS OR A MOVABLE ROLL

(75) Inventors: Edgar Hofstetter, Hohenstein (DE); Norbert Kohfink, Reutlingen (DE)

(73) Assignee: Huyck.Wangner Germany GmbH, Reutlingen (DE)

( * ) Notice: Subject to any disclaimer, the term of this patent is extended or adjusted under 35 U.S.C. 154(b) by 0 days.

(21) Appl. No.: 12/094,805

(22) PCT Filed: Dec. 1, 2006

(86) PCT No.: PCT/EP2006/069178

§ 371 (c)(1),
(2), (4) Date: May 23, 2008

(87) PCT Pub. No.: WO2007/063121

PCT Pub. Date: Jun. 7, 2007

(65) Prior Publication Data

US 2008/0295913 A1 Dec. 4, 2008

(30) Foreign Application Priority Data

Dec. 1, 2005 (DE) ..... 20 2005 018 856 U

(51) Int. Cl.
*D03D 49/60* (2006.01)
*D03D 49/62* (2006.01)
*D03D 49/68* (2006.01)
*D03D 49/00* (2006.01)

(52) U.S. Cl. ..... 139/192; 139/383 AA; 139/188 R; 139/188 A; 139/189; 139/190; 139/191

(58) Field of Classification Search ..... 139/192, 139/383 AA, 188 R, 189, 190, 191, 188 A
See application file for complete search history.

(56) References Cited

U.S. PATENT DOCUMENTS 3,770,024 A * 11/1973 Pfarrwaller ..... 139/189
3,900,050 A * 8/1975 Strauss ..... 139/436
3,926,226 A * 12/1975 Porter ..... 139/190
4,410,015 A * 10/1983 Koller et al. ..... 139/383 AA
4,581,794 A * 4/1986 Oldroyd et al. ..... 28/141

(Continued)

FOREIGN PATENT DOCUMENTS

DE G8122448.6 1/1983

(Continued)

*Primary Examiner*—Bobby H Muromoto, Jr.
(74) *Attorney, Agent, or Firm*—Scott R. Cox

(57) ABSTRACT

The support is provided for a reed of a seam weaving machine used for joining two opposite ends of a synthetic fabric by means of a woven seam. The reed is provided with pivotally mounted reed dents (22). The support includes a tilt strip (24) and a pressure strip (30), as well as devices (26, 32) for positioning the tilt strip (24) and the pressure strip (30) at angles relative to the bearing mechanism. A roll is also provided which can be moved along a track across the width of the reed. A U-shaped bar (40) can also be placed on the front side of the reed dents (22).

15 Claims, 5 Drawing Sheets

U.S. PATENT DOCUMENTS 4,957,143 A * 9/1990 Takahashi et al. ..... 139/190
5,000,230 A * 3/1991 Grossman ..... 139/190
5,003,675 A * 4/1991 Esser et al. ..... 28/141
5,027,483 A * 7/1991 Anderson ..... 28/141
5,117,542 A * 6/1992 Krenkel et al. ..... 28/141
5,183,081 A * 2/1993 Kuster et al. ..... 139/59
5,358,015 A 10/1994 Hacker
5,411,063 A * 5/1995 Hacker et al. ..... 139/383 AA
5,421,373 A * 6/1995 Hacker et al. ..... 139/192
6,014,797 A * 1/2000 Kuster et al. ..... 28/146
6,634,068 B1 * 10/2003 Kuster et al. ..... 26/11
6,948,531 B2 * 9/2005 Hofstetter ..... 139/448

FOREIGN PATENT DOCUMENTS

DE 10330958 2/2005
EP 0236601 9/1987

* cited by examiner

SUPPORT FOR THE REED OF A SEAM-WEAVING MACHINE FOR ROLLING-IN THE SEAM-WEFT THREAD ALTERNATIVELY BY TILTING THE REED DENTS OR A MOVABLE ROLL

TECHNICAL FIELD

The invention relates to a support for the reed of a seam-weaving machine to make a plastic woven fabric continuous by means of a woven seam. To make the woven seam, a seam-weaving shed is formed from seam-warp threads and seam-weft threads are inserted into the seam-weaving shed and shifted against the fell. To shift the seam-weft threads against the fell, the reed has reed dents which are pivotably housed and, starting from the fabric end from which the respective seam-weft thread projects as a warp-thread fringe, press one after the other against the seam-weft thread to be shifted. According to a first mode of operation, the position of the reed dents can be staggered by means of a tilt bar and a pressure bar such that the points at which the reed dents touch the seam-weft thread to be shifted lie approximately on a straight or slightly curved line, the distance of which from the fell constantly changes across the reed.

STATE OF THE ART

Industrial-grade plastic woven fabric for uses where there is an absolutely even surface structure of the fabric, in particular in the case of flat woven plastic paper-forming screens, are made continuous by a woven seam, such as is known from EP-A-0 236 601. To produce a woven seam, warp threads are exposed to a length of e.g. 15 cm at the fabric ends which are to be joined to each other, by removing the weft threads in this area, cf. DE-A103 30 958 (=WO-2005/005718). The so-called woven seam, in which the original weave is exactly reproduced, is then formed from these warp-thread fringes and the weft threads removed from the fabric. To this end, a seam-weaving shed comprising the removed weft threads is stentered, wherein the removed weft threads serve as seam-warp threads. The warp-thread fringes are inserted alternately from the two fabric ends into this seam-weaving shed as seam-weft threads by means of draw-through grippers (cf. EP-A-0 597 494). The warp thread fringes, i.e. the seam-weft threads, and the removed weft threads, i.e. the seam-warp threads, are as a rule monofilaments from 0.1 to 0.5 mm in diameter, and the woven seam is produced after the thermo-setting of the fabric, with the result that the threads already have the corrugation or knuckle corresponding to the respective weave. To obtain a woven seam which has a high tensile strength and does not differ from the rest of the fabric in the pattern of the surface which is decisive for the marking in the paper, the seam-warp threads and the knuckles of the seam-weft threads must interweave in the fabric so that a form locking results. The interweaving of the seam-warp threads and seam-weft threads according to their knuckle is achieved inter alia because the reed does not shift the seam-weft threads simultaneously over the whole length, but the seam-weft threads are progressively shifted through the seam-weaving shed, starting from their point of emergence from the fabric end (root position).

A reed which makes possible such a progressive shift of the seam-weft threads is described in DE-U-81 22 448. The reed can be pivoted into an operating position brought close to the fell. The reed dents housed pivotable on a shaft are held back from the fell by a rubber strip. A roll movable across the reed on a guide track presses the reed dents, against the elasticity of the rubber strip, one after the other against the seam-weft thread. Starting from the fabric end at which the seam-weft thread projects as a warp fringe, the roll is moved along the array of reed dents over the whole seam width for each shifting process.

The same object is achieved according to EP-A-0 043 441 by a rotatable needle cylinder which has a plurality of bending needles which are arranged in helical rows of needles. As a further possibility the shifting of seam-weft threads by means of Z-shaped needles, which are arranged in a guide bed alongside each other and individually axially displaceable, is described in this document. The needles engage in the shed with their front Z-end. The Z-shaped needles are pressed one after the other against the fell by means of a slide, with the result that the seam-weft thread is progressively shifted in a wave motion starting from its point of emergence from the fabric end.

A support for the reed of a seam-weaving machine of the type named at the outset is known from EP-A-0 586 959 in which the position of the reed dents can be staggered such that the points at which the reed dents touch the seam-weft thread to be shifted lie on a straight or slightly curved line, the distance of which from the fell increases starting from the point of emergence of the seam-weft thread from the fabric end. The weaving process can thereby be accelerated as, because of the staggering of the reed dents, the movement of the sley is already enough to progressively shift the seam-weft thread out of the fabric starting from its emerging end.

While the process known from DE-U-81 22 448, in which the reed dents are pressed one after the other against the seam-weft thread to be shifted by means of a roll running past them, can also be used with very complex fabrics, the quicker process, known from EP-A-0 586 959, in which the reed dents are arranged staggered on the sley, cannot be used with very complex fabrics, in particular with some structure-tied fabrics. By structure-tied fabrics are meant multi-layered fabrics in which the binding weft is tied into the fabric structure. If when making a woven seam firstly a sley with staggered reed dents is used according to EP-A-0 586 959 and then too many weaving faults and machine stoppages occur during the seam-weaving process, thus it is very troublesome and time-consuming to change to the process in which a sley with a running roll is used according to DE-U-81 22 448. To change over, the whole sley must actually be removed and replaced by a corresponding different sley. In cases of doubt the process with the running roll is therefore used, although there would be a time saving of 20 to 30% with the process with the staggered reed dents.

DESCRIPTION OF THE INVENTION

Technical Object

The object of the invention is to simplify in a seam-weaving process the change from the seam-weaving process using staggered reed dents to the process using a running roll.

Technical Achievement

According to the invention this object is achieved in that, with a support of the type named at the outset, a roll is provided which can be moved on a guide path across the width of the reed in order to pivot the reed dents one after the other to the fell for operation in a second mode of operation and the tilt strip or the pressure strip can be removed from the reed dents for operation in the second mode of operation.

Advantageous Effects

The tilt strip and the pressure strip impact on the reed dents with opposite torque, with the result that together they determine the position of the reed dents. The reed dents are acted on by the torque created by the tilt strip such that their top ends are pressed towards the fell at one end of the reed and away from the fell at the other, while the pressure strip presses the upper ends of the reed dents towards the fell. Expediently both strips are arranged on the rear of the reed dents, the side facing away from the fell, wherein the tilt strip acts on the reed dents underneath the shaft and the pressure strip acts on the reed dents above this shaft. The tilt strip and the pressure strip are both housed at the support such that they can be pivoted in an approximately horizontal plane. Expediently both are rotatably housed in the centre about a vertical shaft and are acted on at the two side ends by adjustment devices, e.g. pneumatic tilt cylinders and, respectively, bearing pressure cylinders. The tilt cylinders can be controlled such that they take up a specific extended position while the bearing pressure cylinders are controlled such that they apply a specific pressing force.

Preferably the bearing pressure cylinders are controlled such that the bearing pressure cylinder on the side of the root position applies approximately 50% more force than the bearing pressure cylinder on the opposite side, wherein it is assumed that the pressure strip is housed at the centre.

As the sley advances the reed dents push the seam-weft thread to be inserted against the fell. Once the seam-weft thread is attached to the fell it presses the reed dents slightly rearward against the force of the pressure strip. In order to permit this rearward pivot movement of the reed dents, the pressure strip is housed such that it can give rearward. To this end, the normally present pivot bearing in the centre of the pressure strip is housed on a sliding block which allows a movement in the direction of the sley movement. Simultaneously the rearward end-position of the reed dents reached by the sliding block when beating up the reed dents is sensed in order to control the progressive rearward movement of the seam-weaving machine along the fabric ends.

The first mode of operation, in which the reed dents are set tilted, has been previously described. The support according to the invention can be modified with few handles such that the seam-weaving machine can also operate in a second mode of operation, in which the seam-weft threads are shifted by means of a running roll, such as is known from DE-U81 22 448 and has been described above. The roll is moved across the width of the reed on a guide track in order to pivot the reed dents one after the other towards the fell. The guide track of the roll is preferably arranged on the front of the support with the result that the roll acts on the reed dents below the shaft. The reed dents are held approximately vertical by a U-shaped bar which extends over the width of the sley. The U-shaped bar is arranged approximately at the level of the shaft with the result that the upper arm of the U-shaped bar abuts the reed dents above the shaft and the lower arm of the U-shaped bar below the shaft. The upper arm of the U-shaped bar is provided with a microcellular rubber strip and the reed dents are pivoted forwards one after the other by the roll and pressed into the microcellular rubber strip in the process. Depending on the arrangement of the tilt strip and the pressure strip, these interfere when operating in the first mode of operation and must be removed or at least pulled back from the reed dents.

For the change from the first mode of operation into the second mode of operation, the tilt strip and/or the pressure strip, if they interfere, are removed from the reed dents or dismantled, the bearing pressure and tilt cylinders or the other adjustment devices are connected without pressure or drive and the U-shaped bar is attached.

For the change from second mode of operation into the first mode of operation, the U-shaped bar is removed and the roll is moved into a parking position on the edge of the support. Also, the tilt strip and the pressure strip are brought into their operating position and the tilt and bearing pressure cylinders or the other adjustment devices subjected to pressure.

Preferably the support is structured such that the tilt strip and the pressure strip act on the reed dents on the rear, the tilt strip below the shaft and the pressure strip above the shaft, and the roll acts on the reed dents on the front below the shaft and the U-shaped bar abuts the front of the reed dents, wherein the arm of the U-shaped bar abutting the shaft has a microcellular rubber strip. For the change from the first mode of operation into the second mode of operation, the tilt strip then merely needs to be removed and the U-shaped bar screwed on. For the change from second mode of operation into first mode of operation, the U-shaped bar is unscrewed, the roll moved into a lateral parking position and the tilt strip fitted. The pressure strip is present in both modes of operation in this version of the invention as already mentioned, in the first mode of operation its task is to press the reed dents against the seam-weft thread to be shifted and thus this against the fell, and it also has the task of controlling the progressive rearward movement of the seam-weaving machine. In the second mode of operation it has no role and is thus moved back until it no longer abuts the reed dents.

The sley customarily consists of an arm hinged to the bottom end on which a crossarm or sley head is arranged which in turn carries the reed. The sley head is preferably attached to the upper end of the arm by means of a joint, wherein the joint shaft runs parallel to the pivot shaft of the sley.

In the first mode of operation this joint is blocked, with the result that the sley head is rigidly connected to the arm of the sley.

In the second mode of operation, on the other hand, the sley head can be pivoted. By means of adjustment devices, e.g. pneumatic cylinders, the sley head is pressed with an adjustable force against a stop with the result that the reed is in its basic position. In the basic position the reed is aligned approximately parallel to the arm of the sley. In the second mode of operation the angle piece is sensed or scanned in order that the sley head, when beating up the seam-weft thread, pivots rearward, and corresponding to this angle piece the progressive rearward movement of the seam-weaving machine along the fabric ends is controlled according to the advance of the seam.

The forces applied by the draw-through gripper and the bearing pressure cylinders are as small as possible in order to achieve the form locking between the seam-weft thread and the seam-warp threads. A particularly preferred procedure in the first mode of operation is that the stress which the draw-through gripper exerts on the seam-weft thread to be shifted and the force with which the bearing pressure cylinder acts on the pressure bar are not constant during the rolling-in or shifting of the seam-weft thread. These forces are preferably greater at the start, while the seam-weft thread is e.g. being pressed into the first three seam-warp threads, and are then reduced. These increased forces make sense, as the shifting of the seam-weft thread at the so-called root position, i.e. the position from which it emerges from the fabric end as a warp-thread fringe, is particularly difficult and according to experience requires greater forces. If the seam-weft thread is made to engage with say the first three warp threads it makes sense to lower the stress applied by the draw-through gripper in order to prevent the corrugation or knuckle of the seam-weft thread from being partly pulled flat. Generally the tension applied by the draw-through gripper is reduced by approximately half and the force applied by the bearing pressure cylinders is likewise approximately halved. As already mentioned, the bearing pressure cylinder on the root side applies in each case approximately 50% more force on the pressure strip than the bearing pressure cylinder on the other side. Reducing the applied forces requires a short period of time, and the sley therefore preferably remains stationary during this period of time once the seam-weft thread has been made to engage with the first seam-warp threads.

This reduction in force when shifting a seam-weft thread in a seam-weaving machine in which the seam-weft thread is progressively introduced by means of a tilted reed is particularly useful when operating the seam-weaving machine with the support according to the invention. However, this process for operating a seam-weaving machine is also suitable and advantageous for operating a seam-weaving machine which can be operated only in the first mode of operation (EP-0 586 959).

BRIEF DESCRIPTION OF THE DRAWINGS

An embodiment example of the invention is explained below with reference to the drawing. There are shown in.

WAY(S) OF CARRYING OUT THE INVENTION

Figure 1:
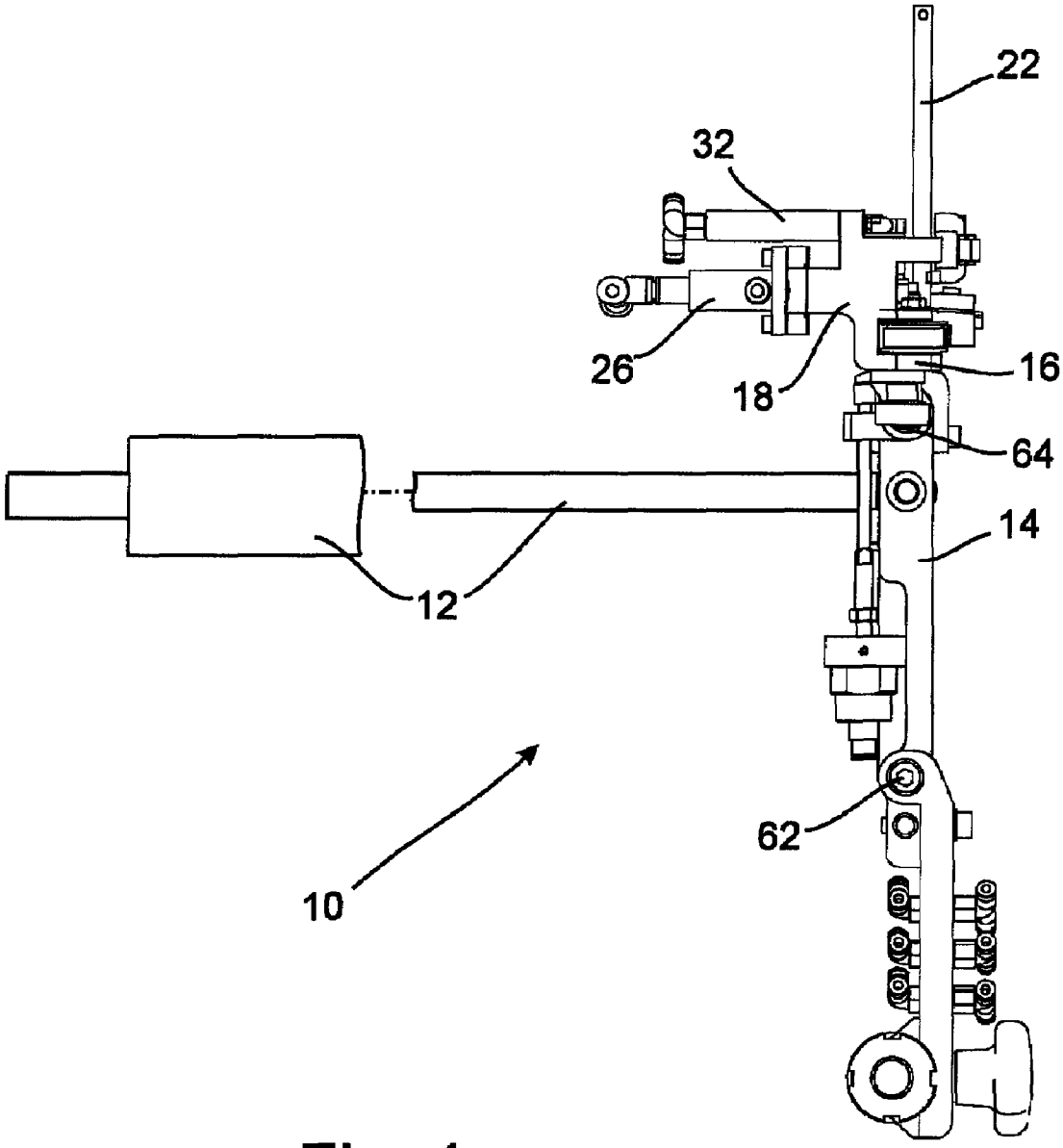
FIG. 1 in a side view, the whole sley including the drive.

In FIG. 1 a sley 10 is shown which is pivoted in customary manner by a linear motor 12 as a sley drive. The sley 10 consists of an arm 14 which can be pivoted at the bottom end in a bearing and at the top end carries a sley head 16, wherein the drive rod of the linear motor 12 is articulated to the arm 14 just below the sley head 16. Bearing supports 18 in which a shaft 20, removable by means of a shaft bar 21 (FIG. 4), is fixed, project upwards at the lateral ends of the sley head 16. Reed dents 22 which in their totality form the reed are ranged on the shaft 20. For reasons of clarity, however, only one of the reed dents is represented. In their lower region the reed dents 22 have a bore with which they are strung onto the shaft 20. Spacing rings lying between keep them at the distance which is predetermined by the thread count of the fabric.

Figure 2:
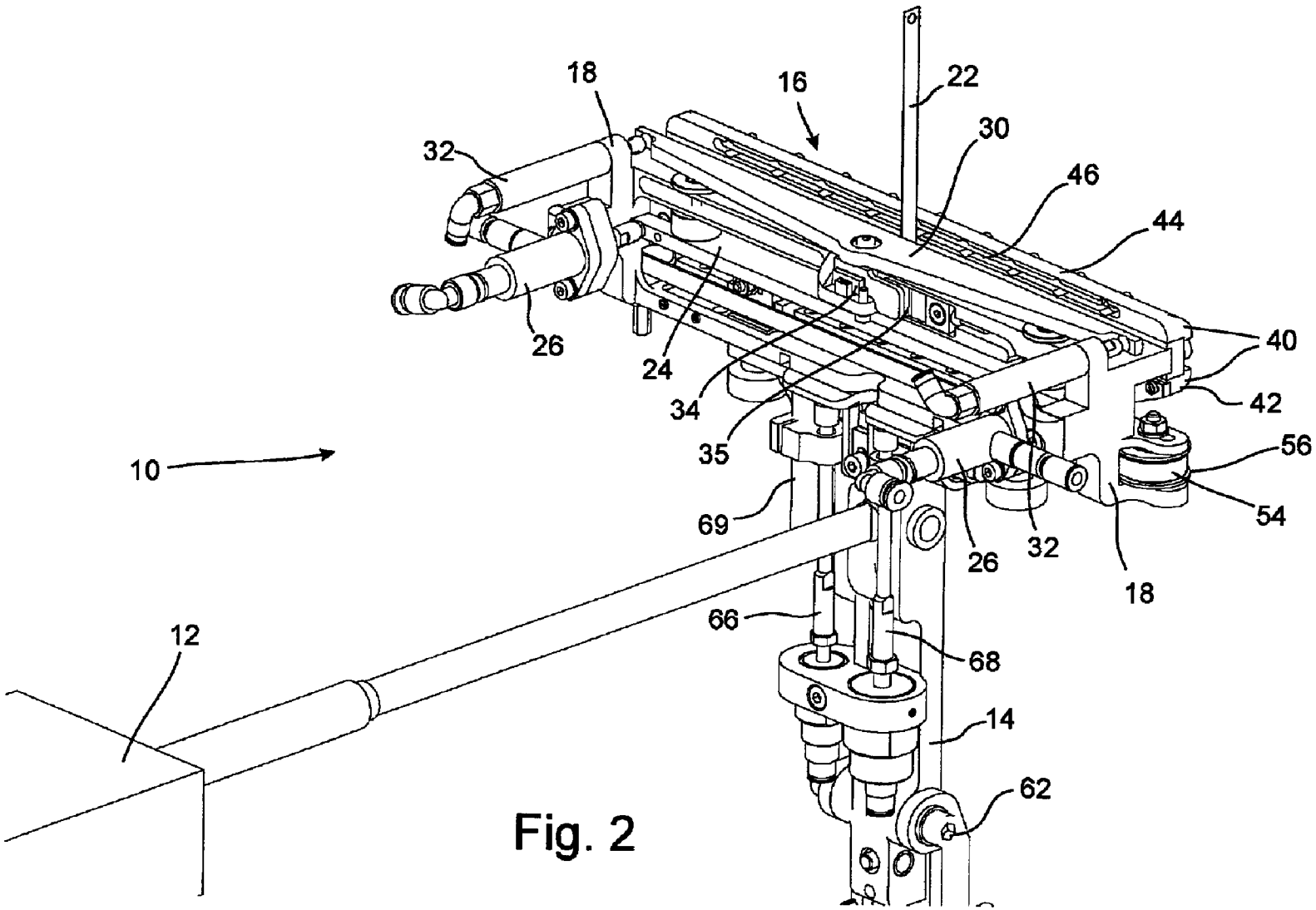
FIG. 2 the support of the reed dents in a spatial representation from above and the rear.
Figure 4:
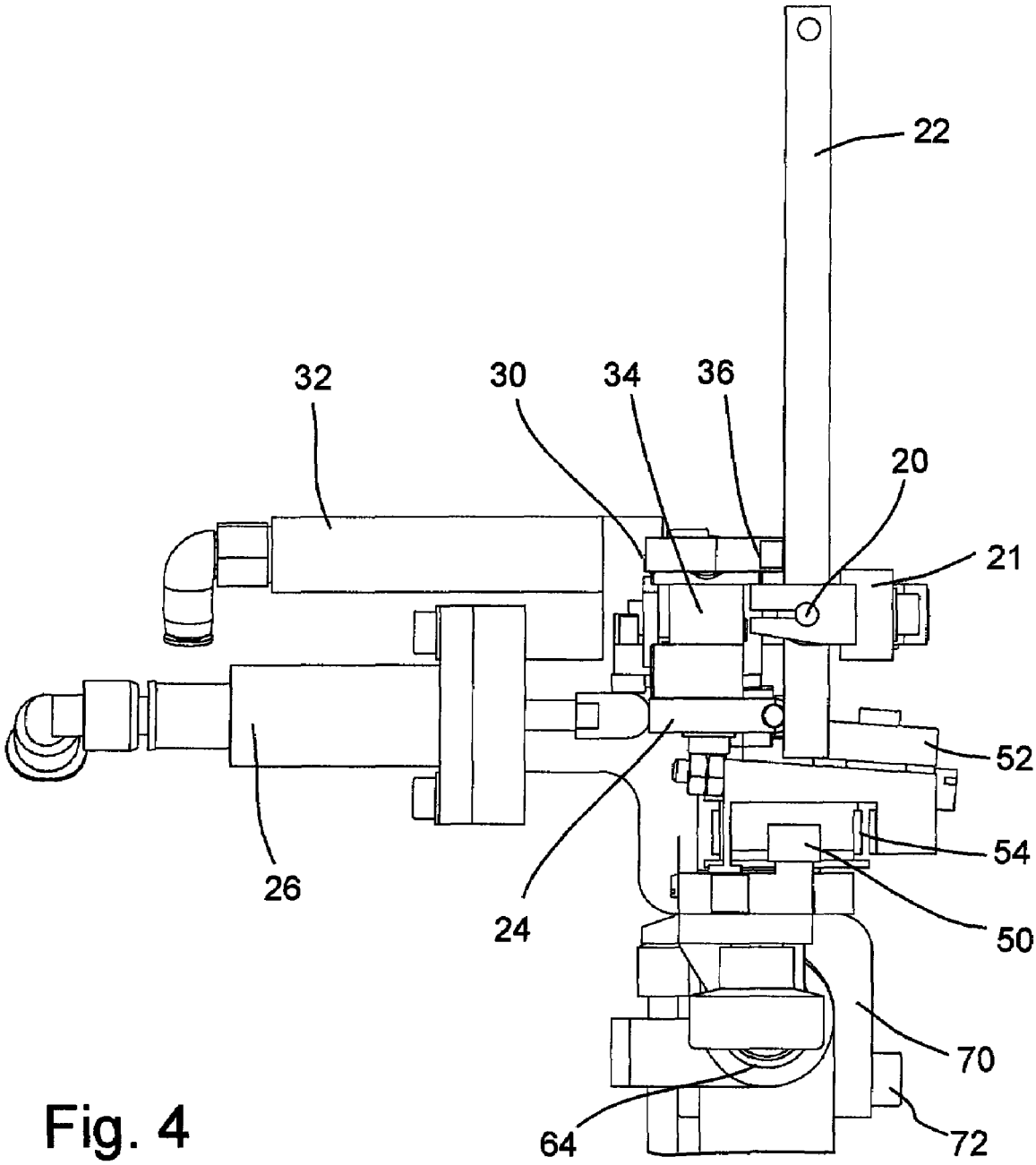
FIG. 4 the support in a side view, set up for the first mode of operation and FIG. 5 the support in a side view, set up for the second mode of operation.

As can be seen from FIG. 2, on the rear of the sley head 16 which faces the linear motor 12, a tilt strip 24 which extends over almost the whole width of the sley head 16 is housed pivotable about a vertical axis, wherein the pivot point is located in the middle of the tilt strip 24. Tilt cylinders 26 which act on the lateral ends of the tilt strip 24 are attached to the two lateral bearing supports 18 (FIGS. 2 and 4). The degree of extension of the tilt cylinders 26 can be set. The tilt strip 24 is arranged below the shaft 20 with the result that it engages with the reed dents 22 below the shaft 20.

A pressure strip 30 is housed similar to the tilt strip 24 above the tilt strip 24 and above the shaft 20 rotatable about a vertical axis. The pressure strip 30 also extends over the whole width of the sley head 16. Bearing pressure cylinders 32 which act on the pressure strip 30 at their lateral ends are also attached to the bearing supports 18. The pressure strip 30 is housed in the middle at a sliding block 34 which can be displaced in a guide in longitudinal direction, i.e. in the direction of the sley movement. The front of the pressure strip 30 which acts on the reed dents 22 is provided with a rubber bearing support 36.

The seam-weaving machine is operated in a first mode of operation by means of the tilt strip 24 and the pressure strip 30. By way of explanation it is assumed that first of all a seam-weft thread which projects from the right-hand fabric end as a warp-thread fringe and has been inserted into the seam-weaving shed by means of a draw-through gripper is now to be rolled in and shifted against the fell by means of the sley. The points at which the reed dents 22 beat up the fell lie approximately in the centre of the length of each of the reed dents 22. These points always lie on a straight or slightly curved line, the so-called beat-up line. When the sley 10 is located at its rear reversal point, the left-hand tilt cylinder 26 is extended and the right-hand tilt cylinder 26 withdrawn. The tilt strip 24 thus rotates in a roughly clockwise direction viewed from above. As the tilt strip 24 engages below the shaft 20 onto which the reed dents 22 are strung, the part of the reed which is located above the shaft 20, and thus the beat-up line, moves in the opposite direction, and the reed is deformed such that the reed dents 22 on the right-hand side are pivoted slightly forwards and the reed dents on the left-hand side slightly rearward. The outermost right-hand reed dent 22 is thus the first to meet the seam-weft thread and presses it against the fell. At the rear reversal point of the sley 10 the pressure in the right-hand bearing pressure cylinder 32 is increased with the result that the seam-weft thread is pressed into the shed with particularly great force immediately after emerging from the fabric end. The draw-through gripper still applies to the seam-weft thread the relatively high draw-through stress with which it has drawn the seam-weft thread through the seam-weaving shed. Because of the high bearing pressure which is applied by the bearing pressure cylinder 32 to the seam-weft thread, and because of the draw-through stress which is applied by the draw-through gripper, it is ensured that the knuckles of the seam-weft thread grip in form locking manner and precisely with the knuckles of the first, i.e. the outermost right-hand, seam-warp threads. As mentioned at the outset, fabric-weft threads are used as seam-warp threads and fabric-warp threads as seam-weft threads, after the thermofixing of the fabric, with the result that the threads have a residual knuckle or corrugation. In order that the woven seam in the woven pattern does not differ from the fabric, the seam-warp threads and the seam-weft threads must interlock with their knuckles again corresponding to the weave. The creation of this engagement between seam-weft thread and seam-warp threads is particularly critical in the first three seam-warp threads. In order to bring the seam-weft thread into engagement with the first three seam-warp threads, the pressure in the bearing pressure cylinders 32 is approximately doubled. When the engagement with the first three seam-warp threads is created, the pressure is reduced to the normal value, thus approximately halved. The sley 10 remains stationary during the period of time necessary for the pressure reduction. This period of time is e.g. approximately 50 ms. Simultaneously the stress applied by the draw-through gripper is also reduced from the draw-through stress to the hold or roll-in stress.

While the outermost right-hand reed dents 22 press the seam-weft thread into the seam-warp threads, the sley 10 moves on. The chosen pressure in the bearing pressure cylinders 32 is such that the pressure strip 30 is pressed rearward by the reed dents 22 which have reached the fell, i.e. pivoted clockwise in the chosen example. The reed dents 22 act progressively from right to left on the seam-weft thread to be shifted with the result that finally this is completely pressed against the fell and engages with the seam-warp threads. Generally, the next seam-weft thread to be shifted is a warp-thread fringe which projects from the left-hand fabric end. The tilt cylinders 26 and the bearing pressure cylinders 32 are therefore controlled in mirror-image fashion, i.e. the right-hand tilt cylinder 26 is now extended and the pressure in the left-hand bearing pressure cylinder 32 raised to the pressure necessary to press the seam-weft thread into the first left-hand seam-warp threads.

Depending on the horizontal distance of the bearing of the sley 10 from the fell, the sliding block 34 at which the pressure strip 30 is housed is shifted rearward to a greater or lesser degree after the shifting of a seam-weft thread. The rearward end-position reached by the sliding block 34 when beating up the reed dents 22 is sensed by a first sensor 35. If the displacement of the end-position exceeds a predetermined extent, the seam-weaving machine is moved rearward from the fell by a predetermined step. The progression of the fell is thereby taken into account. As both fabric ends fest are clamped fast, it is the seam-weaving machine which must be moved on according to the progress of the seam.

Figure 3:
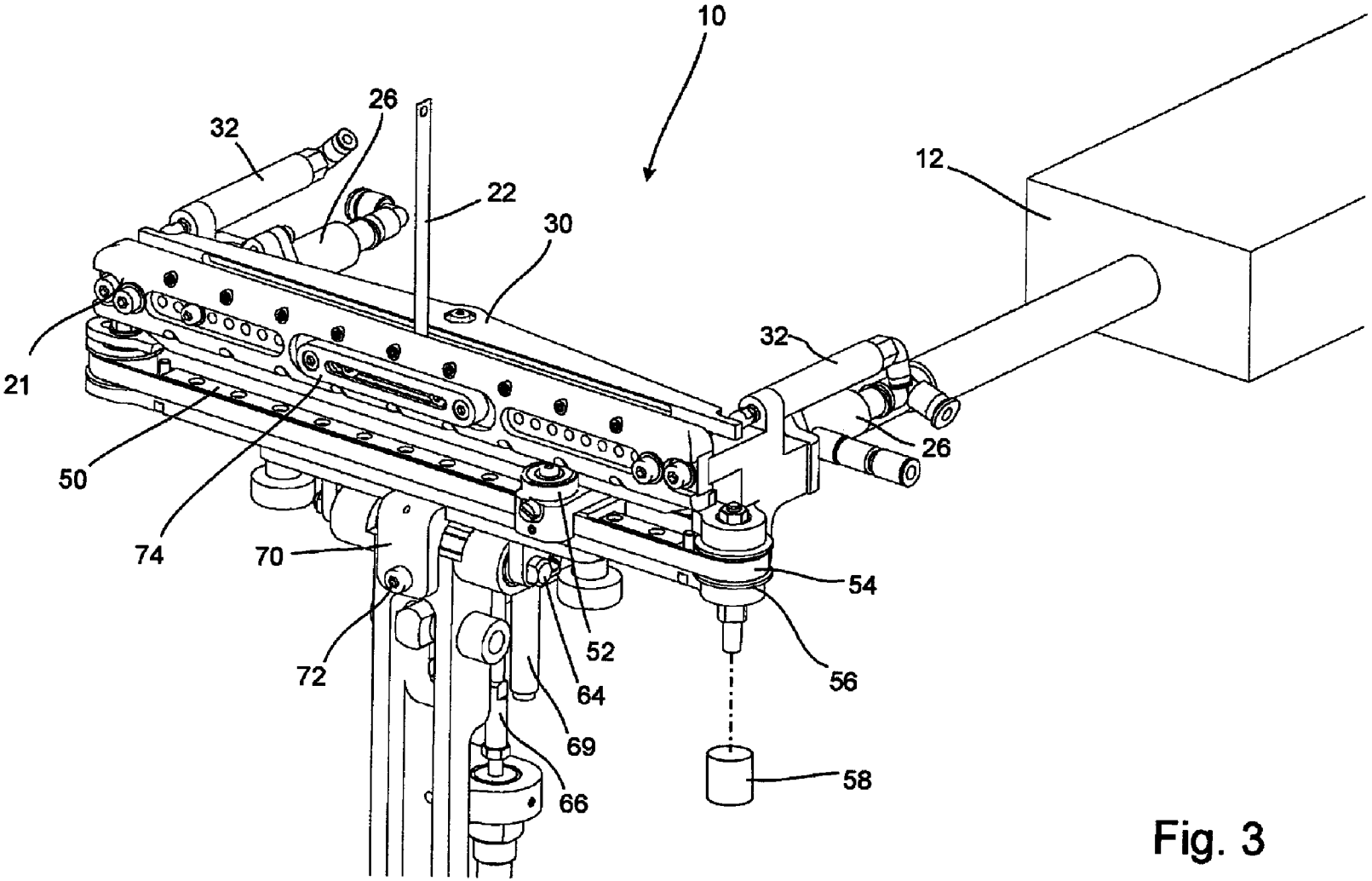
FIG. 3 the support of the reed dents in a spatial representation from above and the front.
Figure 5:
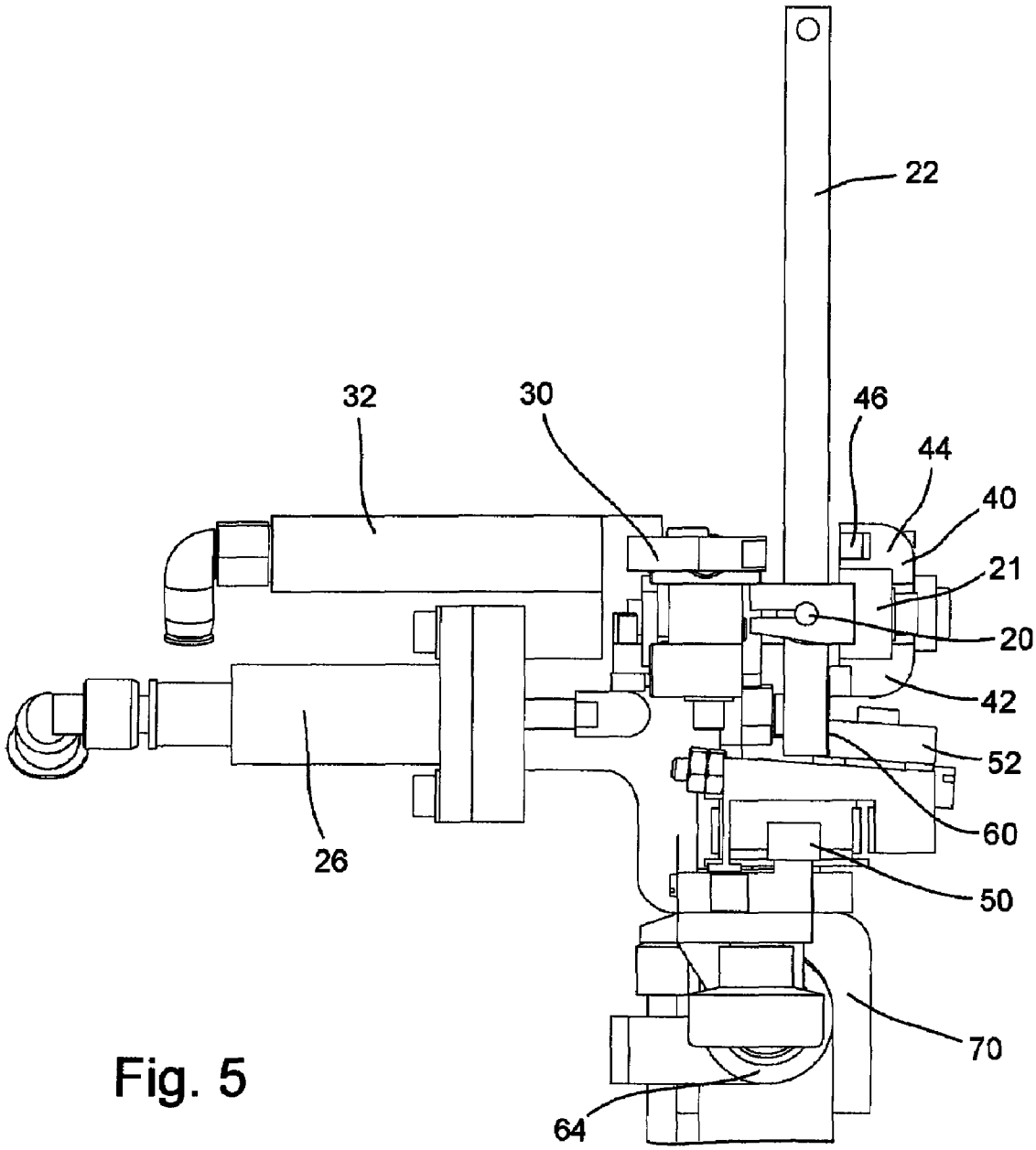

The seam-weaving process according to this first mode of operation is very quick, but cannot be used with all fabrics. With very complex fabrics, in particular with structure-tied fabrics, it has thus far not been possible to use it. If too many faults occur when making a continuous fabric and therefore the seam-weaving machine too often remains stationary, then it is possible to change the invention over to a second mode of operation with which almost all fabric can be made continuous. This requires a modification of the sley 10. In FIGS. 1 to 3 both the components necessary for the first mode of operation and those necessary for the second mode of operation are fitted to the sley 10. FIG. 4 shows, on the other hand, the sley 10 with the components which are necessary for the first mode of operation, and FIG. 5 shows the sley 10 with the components which are necessary for the second mode of operation, wherein in each case the interfering components of the other mode of operation are removed or have been moved out of the operating position.

To modify the sley 10 from the first into the second mode of operation, the reed dents 22 can remain on the shaft 20, but the tilt strip 24 is removed and a bar 40 with a U-profile is attached in front of the reed dents 22, added to which the bearing pressure cylinders 32 are connected without pressure, with the result that the pressure strip 30 no longer abuts the rear of the reed dents 22. As will be explained later in more detail, the fixing of a joint 64 between the sley head 16 and the arm 14 is also released for the second mode of operation. The U-shaped bar 40 is screwed on at approximately the level of the shaft 20 to the shaft bar 21 to which the shaft 20 with the reed dents 22 is attached. The lower arm 42 of the U-profile of the bar 40 abuts the reed dents 22 below the shaft 20, and the upper arm 44 of the U-profile abuts the reed dents 22 above the shaft 20. The upper arm 44 carries a microcellular rubber strip, not shown, which is inserted into a groove 46 on the rear of the upper arm 44.

Below the lower arm 42 on the sley head 16 there is a guide track 50 which extends over the whole width of the sley head 16 and in which a roll 52 is guided. In the second mode of operation the roll 52 acts on the bottom ends of the reed dents 22 below the lower arm 42, with the result that the upper, substantially longer part of the reed dents 22 is pivoted forwards and in the process is pressed into the microcellular rubber strip on the rear of the upper arm 44 of the bar 40. When the roll 52 is moved into the guide track 50 over the front side of the sley head 16, it presses the reed dents 22 forward one after the other. The roll 52 is carried by a sliding block, sliding in the guide track 50, which is fixed to a toothed belt 54 which is guided over two cogged-belt pulleys 56 which are arranged laterally at the bearing supports 18. The left-hand cogged-belt pulley 56 is driven by a step motor 58 (FIG. 3). In the first mode of operation the roll 52 is not needed and is therefore moved into a lateral parking position.

To shift the seam-weft threads in the second mode of operation, the sley 10 is pivoted into its front end-position in which the reed dents 22, the beat-up line of which is aligned parallel to the fell in the second mode of operation, stand immediately in front of the fell or can already touch the seam-weft thread to be shifted. The sley 10 stops briefly in its front end-position, while the roll 52 is pulled along the guide track 50 and in the process briefly pivots out the individual reed dents 22 one after the other, with the result that these can then roll the seam-weft thread into the shed. After the roll 52 has passed, the individual reed dents 22 are pivoted back into their starting situation by the microcellular rubber strip in the groove 46. The roll 52 thus creates a continuous wave in the reed dents 22.

A sheet-metal strip 60 which extends over the whole width of the sley head 16 and is attached to the lower arm 42 is arranged before the bottom ends of the reed dents 22. The roll 52 thereby does not directly act on the bottom ends of the reed dents 22, but firstly displaces only the sheet-metal strip 60 which transmits this displacement onto the reed dents 22. The shape of the continuous wave can be influenced by the elasticity of the sheet-metal strip 60. The more elastic the sheet-metal strip 60, the steeper the edges of the wave. If a flatter wave is desired, a thicker sheet-metal strip 60 of lower elasticity can be used, or two sheet-metal strips 60 can be inserted.

As is seen in FIG. 1, the arm 14 of the sley 10 has a joint 62 approximately in the middle of its length. The angle which the sley head 16 and thus the reed dents 22 adopt vis-à-vis the fell can be set by means of this joint 62.

The sley head 16 is articulated to the top end of the arm 14 by means of the joint 64 already mentioned above (FIG. 3). The joint 64 is operative only in the second mode of operation. The sley head 16 can be tilted by two pneumatic pressure cylinders 66, 68. The left-hand pressure cylinder 66 is smaller in size and is used in the second mode of operation to control the force with which the reed is pressed against the fell. A second sensor 69 is fitted to the arm 14 of the sley 10 and senses the angle of tilt of the sley head 16 around the joint 64. The second sensor 69 ascertains the end-position reached under the force of the left-hand pressure cylinder 66 and thereby controls the progressive rearward movement of the seam-weaving machine.

The larger right-hand pressure cylinder 68 serves likewise in the second mode of operation to support the sley head 16 at the rear reversal point of the sley movement in order that this and the reed dents 22 do not strike the harness. When the sley 10 moves rearward the right-hand pressure cylinder 68 is therefore subjected to pressure.

Attached to the bottom of the sley head 16 is an angle piece 70, the vertical arm of which rests against the front of the arm 14 when the reed is aligned parallel to the arm 14, and which thereby prevents the sley head 16 from tilting forwards. In the first mode of operation the joint 64 is fixed by solidly connecting the angle piece 70 to the arm 14 by means of a threaded bolt 72 (FIGS. 3 and 4). The pressure cylinders 66, 68 are thereby without effect in the first mode of operation.

For the second mode of operation, on the other hand, the threaded bolt 72 is removed (FIG. 5), with the result that the joint 64 becomes operative.

In a recess of the U-shaped bar 40 a thrust block 74 is arranged which in the first mode of operation serves to bend the shaft 20, as shown in FIGS. 5 and 6 of EP-0 586 959, in order to match the shape of the reed to the curvature of the fell.

LIST OF REFERENCE NUMBERS

10 sley
12 linear motor
14 arm
16 sley head
18 bearing supports
20 shaft
21 shaft bar
22 reed dents
24 tilt strip
26 tilt cylinder
30 pressure strip
32 bearing pressure cylinder
34 sliding block
35 first sensor
36 rubber bearing support
40 U-shaped bar
42 bottom arm
44 top arm
46 groove
50 guide track
52 roll
54 toothed belt
56 cogged-belt pulley
58 step motor
60 sheet-metal strip
62 joint
64 joint
66 left-hand pressure cylinder
68 right-hand pressure cylinder
69 second sensor
70 angle piece
72 threaded bolt
74 thrust block

The invention claimed is:

1. A support for a reed of a seam-weaving machine for connecting two opposite fabric ends of a plastic woven fabric by means of a woven seam, for the production of which from seam-warp threads a seam-weaving shed is formed and seam-weft threads which project from the fabric ends as warp fringes are inserted into the seam-weaving shed and shifted against a fell, wherein the reed has reed dents for shifting the seam-weft threads against the fell, the support comprising a bearing device to pivotably house the reed dents;

a tilt strip and a pressure strip which are arranged at a distance from the bearing device and are adapted to exert opposite torques on the reed dents;

adjustment devices for setting the tilt strip and the pressure strip at angles vis-à-vis the bearing device, in order to stagger the position of the reed dents for operation in a first mode of operation by means of the tilt strip and the pressure strip such that the points at which the reed dents touch the seam-weft thread to be shifted lie on a straight or slightly-curved line, the distance of which from the fell across the reed changes constantly, and that the reed dents press against these one after the other and shift them to the fell, starting from the fabric end from which the seam-weft thread to be shifted projects as a warp fringe; and a roll which is adapted to be moved on a guide track over the width of the reed, in order to pivot the reed dents one after the other towards the fell for operation in a second mode of operation, and that at least one of the tilt strip and the pressure strip can be removed from the reed dents for operation in the second mode of operation.

2. The support according to claim 1, wherein in the first mode of operation the reed dents abut the pressure strip which transmits the force onto the reed dents which force is necessary for shifting the seam-weft thread.

3. The support according to claim 2, wherein the pressure strip is housed pivotably about a vertical axis and movable towards and away from the bearing device of the reed dents.

4. The support according to claim 1, wherein the tilt strip acts on the reed dents on the rear below the shaft, the pressure strip acts on the reed dents on the rear above the shaft, wherein a U-shaped strip is arranged on the front of the reed dents and with its bottom arm acts on the reed dents below the shaft and with its top arm the reed dents above the shaft, wherein in the first mode of operation the U-shaped bar is removed and in the second mode of operation the tilt strip is removed and the adjustment devices for setting the pressure strip are attached without pressure.

5. The support according to claim 1, wherein a rubber strip is arranged across the reed and wherein the reed dents abut the rubber strip in the second mode of operation and are pressed into same by the roll.

6. The support for a reed according to claim 1, further comprising a sley of a seam-weaving machine for connecting the two opposite ends of a plastic woven fabric with a support.

7. The support for a reed according to claim 2, further comprising a sley of a seam-weaving machine for connecting the two opposite ends of a plastic woven fabric with a support for the reed.

8. The support according to claim 3, further comprising a sley of a seam-weaving machine for connecting the two opposite ends of a plastic woven fabric with a support for the reed.

9. The support according to claim 4, further comprising a sley of a seam-weaving machine for connecting the two opposite ends of a plastic woven fabric with a support for the reed.

10. The support according to claim 5, further comprising a sley of a seam-weaving machine for connecting the two opposite ends of a plastic woven fabric with a support for the reed.

11. The support according to claim 1, further comprising a control means for use with the reed and with a draw-through gripper for inserting the seam-weft thread into the shed, wherein the force with which the draw-through gripper clamps the seam-weft thread and the force with which the bearing pressure cylinders act on the pressure bar are reduced after the seam-weft thread has been made to engage with say the first three seam-warp threads.

12. The support according to claim 2, further comprising a control means for use with the reed and with a draw-through gripper for inserting the seam-weft thread into the shed, wherein the force with which the draw-through gripper clamps the seam-weft thread and the force with which the bearing pressure cylinders act on the pressure bar are reduced after the seam-weft thread has been made to engage with say the first three seam-warp threads.

13. The support according to claim 3, further comprising a control means for use with the reed and with a draw-through gripper for inserting the seam-weft thread into the shed, wherein the force with which the draw-through gripper clamps the seam-weft thread and the force with which the bearing pressure cylinders act on the pressure bar are reduced after the seam-weft thread has been made to engage with say the first three seam-warp threads.

14. The support according to claim 4, further comprising a control means for use with the reed and with a draw-through gripper for inserting the seam-weft thread into the shed, wherein the force with which the draw-through gripper clamps the seam-weft thread and the force with which the bearing pressure cylinders act on the pressure bar are reduced after the seam-weft thread has been made to engage with say the first three seam-warp threads.

15. The support according to claim 5, further comprising a control means for use with the reed and with a draw-through gripper for inserting the seam-weft thread into the shed, wherein the force with which the draw-through gripper clamps the seam-weft thread and the force with which the bearing pressure cylinders act on the pressure bar are reduced after the seam-weft thread has been made to engage with say the first three seam-warp threads.

* * * * *